US005823758A

United States Patent [19]

Lack

[11] Patent Number: 5,823,758

[45] Date of Patent: Oct. 20, 1998

[54] FUEL COMBUSTION ENHANCING CATALYTIC COMPOSITION AND METHODS OF FORMULATING AND UTILIZING SAME

[76] Inventor: Lloyd Lack, 117 Lillie St., Battle Creek, Mich. 49015

[21] Appl. No.: 736,527

[22] Filed: Oct. 24, 1996

[51] Int. Cl.[6] ..... F23J 7/00; C10L 1/12; C10L 1/18

[52] U.S. Cl. ..... 431/4; 44/357; 44/436; 44/457

[58] Field of Search ..... 502/305, 79, 366; 44/357, 436, 457; 431/4

[56] References Cited

U.S. PATENT DOCUMENTS

| | | | |
|---|---|---|---|
| 4,131,433 | 12/1978 | Scott | 44/51 |
| 5,266,082 | 11/1993 | Sanders | 44/357 |
| 5,501,807 | 3/1996 | Benda | 252/18 |

OTHER PUBLICATIONS

The Petroleum Handbook, pp. 11–15 and 11–24, 1960.

*Primary Examiner*—Wayne Langel

*Attorney, Agent, or Firm*—Weiner & Burt, PC; Irving M. Weiner; Pamela S. Burt

[57] ABSTRACT

A composition for enhancing combustion of hydrocarbon fuels such as LPG, gasoline and diesel fuel comprises at least one metal oxide catalyst dispersed in a liquid organic carrier compatible with the hydrocarbon fuel. The metal oxide catalyst preferably includes at least one of chromium oxide, magnesium oxide, manganese oxide, cobalt oxide, iron oxide and mixtures thereof; and the liquid organic carrier preferably includes Stoddard solvent together with at least one of a high temperature lubricant, a surfactant, and a polar organic solvent. The composition permits the hydrocarbon fuel to be combusted substantially completely so as to reduce emissions associated with incomplete oxidation, and also permits the combustion to occur at lower temperatures for avoiding formation of $NO_x$.

18 Claims, No Drawings

FUEL COMBUSTION ENHANCING CATALYTIC COMPOSITION AND METHODS OF FORMULATING AND UTILIZING SAME

BACKGROUND OF THE INVENTION

1. Field of the Invention

The invention relates to a fuel combustion enhancing catalytic composition, and to methods of formulating and utilizing same. More particularly, the invention pertains to a catalytic additive which is combined with fuel such as LPG, gasoline and diesel fuel, so that the fuels are combusted more efficiently and with less polluting emissions, and to methods of formulating and utilizing the catalytic additive.

2. Description of Relevant Art

In the art there are known additives for being combined with various fuels such as LPG, gasoline, diesel fuel, fuel oil, etc. to enhance the combustion characteristics of the fuel for reducing polluting emissions of carbon monoxide (CO), particulates, unburned hydrocarbons, etc., and to reduce equipment problems normally encountered in the combustion of various fuels.

For example, applicant has previously sold a combustion enhancing additive particularly useful in carbureted LPG combustion systems for internal combustion engines, such as the engines on fork lifts and the like, which additive is known by the trademark CGX-4®. Such known product comprises a blend of a high temperature lubricant, such as a high flash point top oil, at least one detergent or surfactant, and at least one emulsifier, including a polar solvent such as one or more alcohols, in an appropriate organic carrier such as a Stoddard solvent. The high temperature lubricant is effective for lubricating the top cylinder area of the engine because it doesn't flash off until just before the combustion is complete, the surfactant and/or detergent reduces the surface tension of "free water" inevitably contained in the fuel and together with the emulsifier(s) assure that the water is disbursed in the fuel as it is combusted instead of remaining trapped in fuel lines and fuel tanks, where it would cause problems with freezing, etc. Additionally, the known additive functions to stabilize propylene molecules and to break down longer chain hydrocarbons, contaminants which are commonly encountered in LPG so that these contaminants are more thoroughly and efficiently combusted. The prior additive is even effective for emulsifying and removing deposits of the longer chain hydrocarbons which may have deposited in the carburation mechanism during prior use.

Overall, the known additive is effective for reducing the amount of polluting emissions caused by the incomplete combustion of LPG fuel, including carbon monoxide (CO), unburned hydrocarbons and particulate emissions, it improves combustion efficiency, and hence the mileage and power which are achieved for a given quantity of LPG fuel, and significantly reduces down time and maintenance costs because it avoids problems typically associated with water build up, build ups of heavy ends, and emissions.

Although the known additive is very advantageous in many respects, as discussed above, it still remains to be improved in other respects. For example, even with the additive combined therein, the combustion efficiency or oxidation of LPG is not 100%, resulting in emissions of several pollutants, the most important of which are carbon monoxide, particulates and unburned hydrocarbons. Such emissions may be decreased by several techniques such as use of higher primary zone temperatures, longer residence times, and premixing and pre-vaporization of fuel, but there still remains emission problems associated with incomplete oxidation of the LPG fuel. Also, such incomplete oxidation results in fouling of the combustion equipment, which increases maintenance requirements, and causes undesirable down time.

Further, and beyond the problems caused by incomplete oxidation in the combustion of fuels, other significant pollutants resulting from the combustion process are sulphur oxides and nitrogen oxides ($NO_x$). The emission of sulphur oxides is due to the sulphur content of the fuel being combusted, and for liquid or gaseous fuels such as LPG these normally do not constitute a major pollutant. On the other hand, nitrogen oxides ($NO_x$) form through the oxidation of the nitrogen contained in the fuel and/or in the air. Since the activation energy for the reaction of nitrogen and oxygen to form $NO_x$ is very high (approximately 79 Kcal/gm mole), $NO_x$ forms significantly only at high temperatures and its concentration in the combustion exhaust may theoretically be maintained within acceptable limits if the combustion temperatures are held below 1500° C.

The foregoing discussion may suggest that significant formation of $NO_x$ may be avoided by carrying out complete combustion of the LPG fuels at lower temperatures. Although sufficiently low emission temperatures are acceptable for many practical purposes, the equivalence or optimum ratios to which they correspond are too lean for a conventional LPG flame to be stable. In diffusion flames, caused by delayed mixing of the fuel and air after it leaves the nozzle, the $NO_x$ emission levels are typically 70–100 ppm and only using special procedures can then be reduced to levels as low as 30 ppm. Kesseling J. P., and Brown, R. A., Catalytic Oxidation Of Fuels For $NO_x$ Control From Area Sources, E.P.A-600/2-76-037(1976). Similar emission levels of $NO_x$ are obtained from premixed flames of LPG. Thus, it will be understood that high combustion temperatures, which are desirable for flame stability and decreasing pollutants from incomplete oxidation of fuels, are undesirable to the extent that they increase the levels of $NO_x$ in the combustion exhaust.

SUMMARY OF THE INVENTION

The present invention is an improvement of applicant's prior LPG combustion enhancing additive which permits the fuel to be more completely oxidized during combustion in comparison to the prior product for thereby improving energy output and decreasing emissions of carbon monoxide, particulates, unburned hydrocarbons and the like, and which also permits the combustion to be stably carried out at lower temperatures, for thereby reducing emissions of $NO_x$.

According to the invention there is provided a composition for enhancing combustion of hydrocarbon fuel, comprising at least one metal oxide catalyst dispersed in a liquid organic carrier compatible with the hydrocarbon fuel. Preferably the metal oxide catalyst comprises at least one alkaline earth metal oxide or transition metal oxide, and most preferably the metal oxide catalyst is selected from the group consisting essentially of chromium oxide, magnesium oxide, manganese oxide, cobalt oxide, iron oxide and mixtures thereof. Further, the organic carrier preferably comprises a Stoddard solvent, and the composition preferably also includes a surfactant, an emulsifier such as a polar organic solvent, and a high temperature lubricant.

The metal oxide(s) function as catalysts solvent for the combustion of the hydrocarbon fuel, and when added even in very small quantities, e.g., 1–50 ppm, are effective for achieving substantially complete oxidation of the fuel, and hence for reducing polluting emissions asociated with incomplete oxidation.

Moreover, catalytic combustion of the hydrocarbon fuel with metal oxide(s) according to the invention has a large thermal inertia associated therewith, whereby the lower limit of flame stability for the combustion is decreased, permitting lower combustion temperatures to be used and thereby minimizing formation of $NO_x$ emissions.

According to the invention there is also provided a method of combusting hydrocarbon fuels, comprising the steps of: combining the hydrocarbon fuel with a dispersion of a metal oxide catalyst in a liquid organic carrier compatible with the hydrocarbon fuel; and combusting the combined hydrocarbon fuel and catalytic dispersion at a maximum temperature below 1500° C. Again, it is preferable that the metal oxide catalyst comprises at least one of a transition metal oxide and an alkaline earth metal oxide, and most preferable that the metal oxide catalyst is selected from the group consisting essentially of chromium oxide, magnesium oxide, manganese oxide, cobalt oxide, iron oxide, and mixtures thereof; that the organic carrier comprises at least one Stoddard solvent; and that the catalytic dispersion further includes a surfactant, a polar organic solvent, and a high temperature lubricant when the combustion process is a carbureted combustion process in an internal combustion engine.

It is an object of the invention to provide a combustion enhancing catalytic additive for hydrocarbon fuels such as LPG, gasoline and diesel fuel which permits substantially complete oxidation of the fuel to be achieved even when the fuel contains significant quantities of impurities such as free water, propylene, long chain hydrocarbons, etc.

It is another object of the present invention to provide a combustion enhancing additive for hydrocarbon fuels which substantially reduces or eliminates polluting emissions normally caused by incomplete oxidation, while simultaneously reducing emissions of $NO_x$.

It is a further object of the invention to provide a combustion enhancing additive which can be readily and economically manufactured and combined with hydrocarbon fuels.

It is still another object of the invention to provide a method of combusting hydrocarbon fuel together with a combustion enhancing additive according to the invention so as to reduce emissions of pollutants relating to complete oxidation, and to simultaneously reduce formation and emissions of $NO_x$.

Other objects, advantages and salient features of the invention will be apparent from the following detailed description of the preferred embodiments of the invention.

DETAILED DESCRIPTION OF THE PREFERRED EMBODIMENTS

As discussed above, the fuel combustion enhancing catalyst according to the invention comprises at least one metal oxide, and preferably at least one of a metal oxide or transition metal oxide including chromium oxide, magnesium oxide, manganese oxide, cobalt oxide, iron oxide, and mixtures thereof. Applicant has determined that these metal oxides are very effective for use as fuel combustion enhancing catalysts because the compounds not only promote total oxidation of hydrocarbons, but also permit the combustion process to be performed at lower temperatures which are not favorable for the formation of $NO_x$, and they also have good thermal stability.

In general, the oxidation process in the conventional flame combustion of a fuel such as LPG is a homogeneous reaction taking place in the bulk gas phase. Through introduction of a catalyst in the combustion process, heterogeneous oxidation on the surface of the catalyst also takes place, and by the choice of a suitable catalyst is possible to reduce the activation energy necessary for the heterogeneous catalytic reaction to a level much lower than required for the purely homogeneous combustion. For example, applicant has found that for combustion burning of light hydrocarbon fuel such as propane, the activation energy for the uncatalyzed homogeneous oxidation reaction is approximately 25–50 Kcal/gm-mole, while that for the heterogeneous catalytic oxidation reaction is approximately 11–15 Kcal/gmmole. Thus, appreciable heterogeneous (catalytic) oxidation rates can be achieved for temperatures and fuel concentrations much lower than those required for the homogeneous (non-catalytic) reactions to proceed.

In a catalytic combuster, the reaction in the initial part of the combustion bed is primarily catalytic and the rate is controlled by the rate of the surface reaction. As the catalytic reaction increases, the gas and surface temperature and therefore the surface reaction rate constant, which increases exponentially with temperature, quickly becomes so large that the rate of transport of reactants to the catalyst surface becomes the controlling factor for the catalytic reaction. Thereafter, the overall heterogeneous reaction rate is controlled by the mass transfer rate to the catalyst surface. The energy release rate in the mass transfer controlled regime is typically orders of magnitude smaller than those obtainable in the conventional (non-catalytic) flames. However, at sufficiently high temperatures which are quickly realized in the combustion process, homogeneous reactions are initiated in addition to the heterogeneous catalytic reactions, and the combustion then rapidly goes to completion and energy release rates comparable to conventional flames are achieved.

Thus, when using a metal oxide catalyst dispersion according to the invention, it is possible and practical to conduct combustion of hydrocarbon fuels such as LPG, gasoline, diesel fuel and fuel oil at sufficiently low inlet temperatures and with lean equivalence ratios such that the resulting combustion and exit temperatures of the emissions from the combustion process are sufficiently low that $NO_x$ formation is minimized, and yet combustion is nearly 100% complete so that there are low emissions therefrom in relation to incomplete oxidation.

According to specific experiments conducted by applicant using an experimental catalytic combuster, the oxides of the alkaline earth metal magnesium and the transition metals chromium, manganese, cobalt, iron and combinations thereof provided the optimum catalytic results. The most active catalyst of these was a binary mixture of chromium oxide and cobalt oxide ($Cr_2O_3$—$Co_3O_4$) which gave complete conversion/oxidation of very lean fuel mixtures of LPG and an equivalence ratio of 0.196 at the low inlet temperatures below 850° C. This catalyst mixture was also found suitable for operation over a wide range of equivalence ratios and inlet temperatures in the combustion of LPG; while the $NO_x$ emission index for the LPG combustion using this catalyst never exceeded 0.11 gm/Kg of fuel. Such emission index is significantly smaller, an order of magnitude smaller, than that achieved in conventional LPG combustion systems, including those using applicant's prior combustion enhancing additive.

According to the experiments conducted by applicant using the discussed oxides of alkaline earth metals and transition metals, combustion was complete in some instances and incomplete in others. In the cases in which complete combustion was achieved, the emission levels of $NO_x$, carbon monoxide and unburned hydrocarbons were very low. The carbon monoxide and unburnded hydrocarbon concentrations were so low that they did not give any reading in gas chromatograph testing, and the $NO_x$ emission index was always below 0.11 gm/Kg fuel.

In cases where the combustion was incomplete, typically because of operation under kinetic or mass transfer control/limitations,the chief pollutant was unburned hydrocarbons. Low levels of carbon monoxide were observed in some cases where the exit temperatures were high and combustion incomplete. $NO_x$ emission levels were always very low and found to be strongly temperature dependent, as expected, but in no case did the concentration of $NO_x$ exceed 0.11 gm/Kg fuel.

In order to combine the metal oxide catalysts with the hydrocarbon fuels the catalysts are initially dispersed in an appropriate organic medium which is compatible with the hydrocarbon fuel. For LPG fuel, applicant has found that the metal oxide catalysts may be properly dispersed in a Stoddard solvent, and most preferably in applicant's prior combustion enhancing additive which comprises primarily Stoddard solvent(s) together with a high temperature lubricant, a detergent or surfactant, and a polar molecular solvent such as an alcohol. Applicant has found that only very small quantities of the metal oxide catalysts are necessary for achieving an optimum combustion conditions according to the invention. Particularly, applicant has found that if the metal oxide catalysts are added in a proportion of 1–50 ppm, and preferably 10–30 ppm, to the hydrocarbon fuel, then complete or substantially complete oxidation/combustion of the fuels can be achieved at sufficietly low inlet temperatures and lean equivalence ratios, whereby including emissions of carbon monoxide, unburned hydrocarbons, particulates, and $NO_x$ are all reduced and energy output for a given quantity of fuel is increased. Fine powders of the metal oxides can be dispersed in a Stoddard solvent, and where the metal oxide powders are dispersed in applicant's prior combustion enhancing additive, the detergent/surfactant and/or the polar molecular solvent therein also assist maintaining the metal oxide powder properly dispersed in the organic medium. For example, applicant has found that a dispersion of the metal oxide catalyst(s) containing 0.5–5 weight percent of the metal oxide powder in a Stoddard solvent may be added to applicant's prior combustion enhancing additive CGX-4® in a ratio of 3–5 volume percent of the dispersion to 95–97 volume percent of the prior additive, for achieving the desirable combustion characteristics as discussed above. The catalytic, modified combustion enhancing additive is then combined with hydrocarbon fuels such as LPG in a ratio of 0.5–2.0 fluid ounces/10.0 gal. Although higher concentrations of the metal oxides catalyst(s) may be added they do not further enhance the combustion characteristics, while otherwise rendering the catalytic additive more expensive to produce.

The combustion enhancing additive is miscible and compatible with LPG fuel, and it is easily combined therewith by simply pouring an appropriate amount of the additive into a tank of the LPG fuel, e.g., pouring 1 oz. into a 10 gallon tank, pouring a 55 gallon drum into a 70,000 gallon tank, etc.

The catalytic fuel combustion enhancing additive according to the invention, like applicant's prior additive CGX-4®, is particularly effective when used in relation to a carburated LPG fuel system for an internal combustion engine. The catalytic additive according to the invention is, however, also effective for use in relation to other fuels such as gasoline, diesel fuel, fuel oil, etc. and in other types of combustion systems such as noncarburated combustion systems. For example, applicant has found that if the additive is used in relation to gasoline, less of the catalyst may be used to achieve the optimum result, such as 0.5–15 ppm, while in relation to diesel fuel it is typically desirable to also add a conventional cold flow improving additive to the solvent mixture, especially in colder climates.

Although there have been described what are present considered to be the presently preferred embodiments of the invention, it will be understood by persons of ordinary skill in the art that modifications and variations may be made thereto without departing from the spirit or essence of the invention. The scope of the invention is indicated by the appended claims, rather than by the foregoing description.

I claim:

1. The composition for enhancing combustion of LPG fuel, comprising at least one metal oxide catalyst dispersed in an organic carrier which is compatible with the LPG fuel;

said metal oxide catalyst is a mixture of chromium oxide ($Cr_2O_3$) and cobalt oxide ($Co_3O_4$); and said organic carrier comprising primarily Stoddard solvent, as well as an emulsifier to maintain the metal oxide catalyst dispersed in the Stoddard solvent and in the LPG fuel when added thereto.

2. A composition according to claim 1, wherein said metal oxide catalyst is combined with said LPG fuel at a ratio of 1–50 ppm.

3. A composition according to claim 1, wherein said metal oxide catalyst is dispersed in said liquid organic carrier at a ratio of <1.0 weight %.

4. A composition according to claim 1, wherein said liquid organic carrier further comprises a high temperature lubricant and a surfactant.

5. A composition according to claim 4, wherein said liquid organic carrier comprises a top oil having a flash point of at least 400° C. as said high temperature lubricant.

6. A composition according to claim 1, wherein said metal oxide catalyst is combined with said LPG fuel at a ratio of 10–30 ppm.

7. A composition according to claim 1, wherein said composition is combined with said LPG fuel in a quantity sufficient to achieve a $NO_x$ emission index for combustion of the LPG fuel of <0.11 gm/kg of LPG.

8. A combustible mixture of LPG fuel and a dispersion of a metal oxide catalyst in a liquid organic carrier compatible with the LPG fuel;

said metal oxide catalyst comprising at least one member from the group consisting of an alkaline earth metal oxide and a transition metal oxide; and said liquid organic carrier comprising primarily Stoddard solvent, as well as an emulsifier to maintain the metal oxide catalyst dispersed in the Stoddard solvent and in the LPG fuel.

9. A combustible mixture according to claim 8, wherein:

said liquid organic carrier comprises 3–5 volume percent of a high temperature lubricant, 3–5 volume percent of a surfactant, 1–3 volume percent of said emulsifier, and a balance of said Stoddard solvent.

10. A method of combusting LPG fuel, comprising the steps of:

combining the LPG fuel with a dispersion of a metal oxide catalyst in a liquid organic carrier compatible with the LPG fuel; and combusting the LPG fuel and dispersion at a temperature below 1500° C.;

said metal oxide catalyst comprising at least one member selected from the group consisting of an alkaline earth metal oxide and a transition metal oxide; and said organic carrier comprising primarily Stoddard solvent and an emulsifier to maintain the metal oxide catalyst dispersed in the Stoddard solvent and in the LPG fuel.

11. A method according to claim 10, wherein said metal oxide catalyst is selected from a group consisting of chromium oxide, magnesium oxide, manganese oxide, cobalt oxide, iron oxide, and mixtures thereof.

12. A method according to claim 10, wherein said metal oxide catalyst comprises a mixture of chromium oxide ($Cr_2O_3$) and cobalt oxide ($Co_3O_4$).

13. A method according to claim 10, wherein said liquid organic carrier further comprises a high temperature lubricant and a surfactant.

14. A method according to claim 10, wherein said liquid organic carrier comprises a mixture of 3–5 volume percent of a high temperature lubricant, 3–5 volume percent of a surfactant, 1–3 volume percent of said emulsifier; and a balance of said Stoddard solvent.

15. A method according to claim 10, wherein said combustion step is effected in a carburated internal combustion engine.

16. A method according to claim 10, wherein said combustion step is effected using an inlet temperature in a range of 800°–1000° C. and at an equivalence ratio in a range of 0.150–0.230.

17. A method according to claim 10, wherein said dispersion is combined with the LPG fuel in a quantity sufficient to achieve a final concentration of metal oxide catalyst in the fuel of 10–30 ppm.

18. A method according to claim 10, wherein said dispersion is combined with the LPG fuel in a quantity sufficient to achieve a $N_x$ emission index for combustion of the LPG fuel of $\leqq 0.11$ gm/kg of LPG fuel.

* * * * *

UNITED STATES PATENT AND TRADEMARK OFFICE

CERTIFICATE OF CORRECTION

PATENT NO. : 5,823,758
DATED : October 20, 1998
INVENTOR(S) : Lloyd Lack

It is certified that error appears in the above-identified patent and that said Letters Patent is hereby corrected as shown below:

Column 6,
Line 37, change "400º C." to -- 400º F. --.

Signed and Sealed this

Twelfth Day of November, 2002

*Attest:*

*Attesting Officer*

JAMES E. ROGAN
*Director of the United States Patent and Trademark Office*